United States Patent [19]

Lam et al.

[11] Patent Number: 4,672,771

[45] Date of Patent: Jun. 16, 1987

[54] TAPE DRIVE WINDOW REGULATOR APPARATUS AND METHOD

[75] Inventors: Michael K. Lam, Southfield; Bohdan Kazewych, Union Lake; Michael D. Kobrehel, Southgate, all of Mich.

[73] Assignee: General Motors Corporation, Detroit, Mich.

[21] Appl. No.: 864,510

[22] Filed: May 19, 1986

[51] Int. Cl.[4] ..... E05F 11/48

[52] U.S. Cl. ..... 49/352; 49/360

[58] Field of Search ..... 49/352, 360; 74/89.2, 74/89.21

[56] References Cited

U.S. PATENT DOCUMENTS 4,004,371 1/1977 Podolan et al. ..... 49/352

4,241,542 12/1980 Podolan et al. ..... 49/352

4,253,277 3/1981 Campbell et al. ..... 49/352

4,335,541 6/1982 Kazewych ..... 49/352 X 4,364,202 12/1982 Zavatkay ..... 49/352

4,592,245 6/1986 Pickles ..... 49/352 X

*Primary Examiner*—Philip C. Kannan

*Attorney, Agent, or Firm*—Ernest E. Helms

[57] ABSTRACT

The present invention provides an improved tape drive window regulator apparatus and method of utilization of the same. The apparatus of the present invention provides a window regulator wherein the slack portion of the tape is laterally stabilized and/or deflected. In addition, an embodiment of the present invention allowed the tape to be placed in a loaded position in respect to deflector by the tape drive mechanism during assembly eliminating an assembly step.

13 Claims, 6 Drawing Figures

TAPE DRIVE WINDOW REGULATOR APPARATUS AND METHOD

FIELD OF THE PRESENT INVENTION

The field of the present invention relates to vehicle tape drive window regulators.

DISCLOSURE STATEMENT

Tape drive window regulators for automotive vehicles are well known in the art. Examples of tape drive window regulator can be found in U.S. Pat. Nos. 4,241,542 and 4,253,277 commonly assigned.

Prior tape drive window regulators have four major elements which include a flexible drive tape which may be utilized in compression or in tension attached to the window at one end, and a guide forming a predetermined path for the drive tape. A reversible drive mechanism is also provided to translate the tape, and an anchor is provided which retains the drive tape's end opposite the window.

There are different versions of drive tapes. One popular version of a drive tape provides an elongated plastic tape with a cross sectioned area approximately two by fifteen millimeters. The tape also has a series of transverse longitudinal equally spaced slots which allow the tape to be driven by a manually or artificially powered sprocketed drive wheel.

The window regulator also includes a frame which provides the anchor for the tape and a mounting for the drive mechanism. The tape is translated in a restrained guided path provided by a molded groove in the frame member and an outwardly extending rail which extends upwardly and then downwardly at an acute angle. As the window is reeled down, the length of the tape limits the downward travel of the window.

As the window is raised up, the tape reverses. Between the molded groove of the frame member and the anchor, there exist an opening. The tape is allowed to enter the opening to create an unrestrain floppy loop. The floppy loop is generated since reeling the tape around the sprocket wheel would place too much strain on the tape from the cyclical tension and compression forces generated by wrapping the tape over the diameter of the sprocket wheel.

In many applications the floppy looped portion of the tape is of no great concern. However, in some automotive applications the floppy loop of the tape can cause problems by hitting other portions of the door interior. When it is desirable to utilize portions of the door interior in close proximity to the window regulator, the loop can cause problems. If the looped portion is allowed to hit other interior members of the door a rattling noise problem can sometimes occur. Also, damage to the tape can sometimes occur.

To overcome the above-noted problems, attempts were made to control the deflection of the looped tape. One attempted solution was to place a single anchor-type tooth on the curvature of the frame between the anchor and the guided path. The tooth would engage with one of the previously described slotted apertures in the tape causing the floppy looped portion of the tape to be deflected. The above attempt failed due to the continual cyclical working of the tape up and down over the single tooth. The slotted aperture of the tape was eventually enlarged causing the tooth to lose all retention on the looped portion of the tape.

Another attempt was made to aid in the deflection of the looped portion of the tape by attaching a portion of the tape between the anchor and guided path to the frame by a metal clip. One problem with the metallic clip was that it required another step in assembly operation. Placement of the metal clip required a fairly high degree of accuracy in assembly to generate the desired results. It was found that the degree of accuracy in placement of the clip was an ergogenic burden in the factory environment. More importantly, the metallic clip caused problems in that it had a barbed member which actually deformed or cut into the drive tape. Therefore the tape was slightly damaged increasing the chance of failure of the tape element.

SUMMARY OF THE INVENTION

To overcome the above-noted and other problems, the present invention is brought forth. The present invention provides a tape deflector which does not deform or injure the tape and can be made integral with the frame member of the window regulator. Since the new deflector can be integral with the frame, problems with the accuracy of placement of the deflector can be eliminated.

In its preferred embodiment the present invention allows the window regulator to be self-loading, allowing the drive mechanism to load the tape into the deflector thereby eliminating a prior required manual assembly step. Also, the present invention provides an embodiment of a deflector which may not only deflect the floppy looped portion of the tape downward, but may also deflect it in an upward direction. The present invention also provides a means of laterally stabilizing the looped floppy portion of the tape thereby eliminating the need for sound insulating materials on the door to suppress the sound generated by the looped portion of the tape laterally swinging over and hitting the interior sides of the door.

It is an object of the present invention to provide a tape drive window regulator wherein the tape has a deflector for the looped floppy portion and the deflector self loads the tape from a position outside of the deflector to a position where it is captured by the deflector. It is an object of the present invention to provide a deflector for the floppy portion of the tape of a tape drive window regulator wherein the looped floppy portion may be deflected in an upward direction. It is another object of the present invention to provide a window drive regulator wherein the looped floppy portion of the tape drive of the window regulator may be laterally stabilized.

It is still yet another object of the present invention to provide a vehicle window tape drive regulator, said regulator including a tape with a plurality of longitudinally equally spaced transverse slotted apertures secured to said window at a first end, a guide means providing a predetermined path for said tape, a reversible drive mechanism drivably engaged with said tape to translate said tape along said guide means in two directions, anchor means spaced from said guide means fixably securing a second end of said tape, and a deflector including an inner deflector member adjacent with said tape between said guide means and said anchor means and an outer deflection member having a male member projecting towards the inner member whereby translation of said tape towards said anchor means causes the male member to insert into said tape causing said tape to deflect upwards and whereby the outer male member has a cammed surface opposite the male member allowing the drive mechanism to load the tape from an area adjacent the cam surface to an area adjacent said male member.

While a few of the embodiments of the present invention have been explained it will be readily apparent to those skilled in the art of the various modifications which can be made to the present invention without departing from the spirit and scope of this application as it is encompassed by the following claims.

DETAILED DESCRIPTION OF THE DRAWINGS

Figure 1:
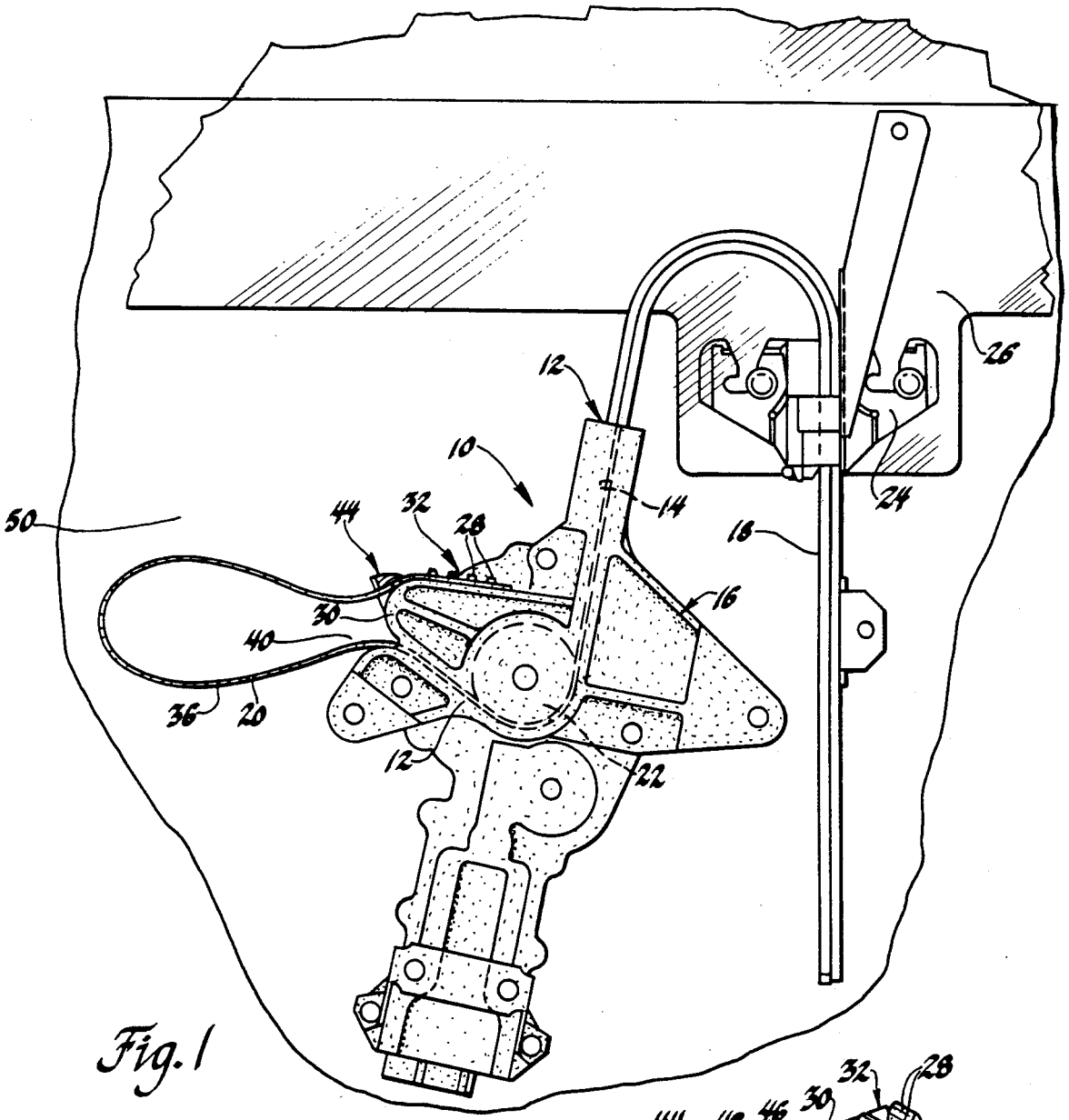
FIG. 1 is a front elevational view of a window regulator of the present invention.
Figure 2:
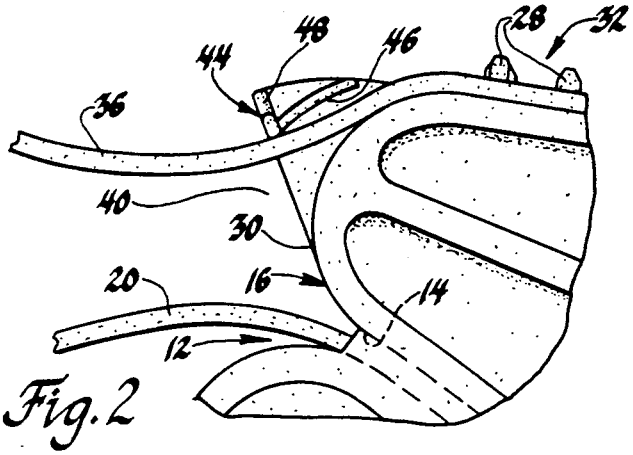
FIG. 2 is a partial enlarged view of a portion of the window regulator illustrated in FIG. 1.
Figure 3:
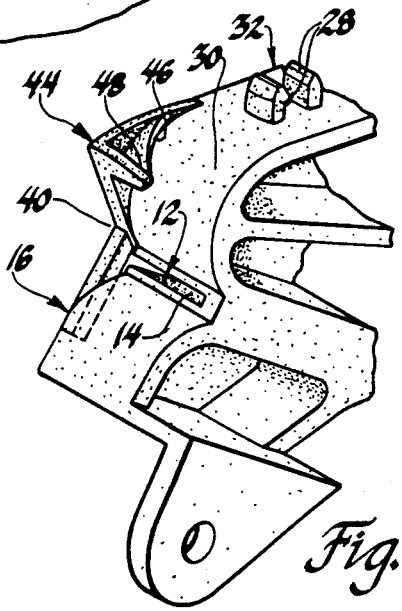
FIG. 3 is an enlarged partial side perspective view of the window regulator illustrated in FIG. 1 with the drive tape removed for clarity of illustration.

Referring to FIGS. 1, 2 and 3, the window regulator 10 of the present invention has a guide path 12. Guide path 12 is formed by a molded groove 14 in the window regulator frame 16, and U-shaped rail 18 which is attached to frame 16. Inserted within the guide path 12 is the plastic drive tape 20 which is usually manufactured by an extrusion process and is provided with equally longitudinally spaced transverse apertures so that it may be fitted around a sprocket wheel 22.

At one end of the drive tape is a bracket 24 which in turn is connected with the window 26. The tape 20 at its opposite end is held down by an anchor 32 provided by teeth 28 formed integrally with the frame 16.

When the window 26 is at its lowermost position, the tape 20 is flush with the curvature 30 between the anchor 32 and the beginning of the guided path 12. Therefore the length of the tape 20 provides the limit of downward travel of the window 26. To raise the window 26 the sprocket wheel 22 is reversed (manually or by a motor), thereby driving tape 20 away from window 26 towards anchor 32. Tape 20 is pushed out into opening 40 and forms a floppy loop 36 which is unrestrained and is free to move relative to the vehicle.

The present invention adds a deflector 44. The deflector 44 impinges upon the loop 36 and causes the loop 36 to form at a lower region than it would normally form without the deflector. Therefore, other controls or mechanism, such as door latches or locks may now be placed in region 50 which was formerly taken up by loop 36. The surface 46 of the deflector towards the anchor 32 and guided path 12 restrains the loop 36 during the loops creation. Opposite surface 46 is a cammed surface 48. When assembling the regulator 10, the tape 20 is first anchored to the frame 16 and allowed to remain outside of the deflector 44. As the window 26 is brought to its lowermost position the tape 20 will be automatically loaded onto the area adjacent surface 46. The self-loading feature is advantageous in that the deflector 44 can now be made integral with the frame member 16 and its location will be exact in all applications. There is no need of manual placement of the deflector 44 and the deflector 44 does not deform or cut into the tape.

Figure 4:
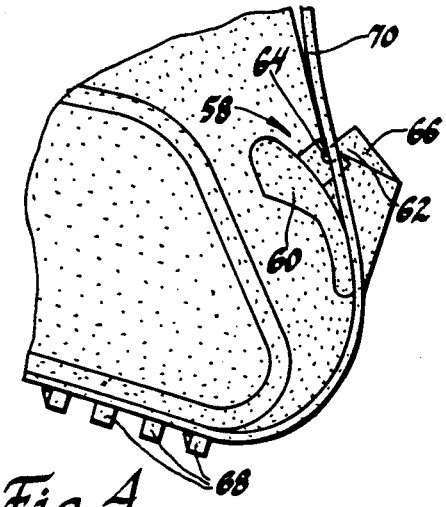
FIG. 4 is a partial enlarged front elevational view of an alternative embodiment of the present invention.

Referring to FIG. 4, there is provided an alternative embodiment of the deflector 58 which is typically more suitable when it is desired to deflect the looped portion of the tape in an upward direction. The deflector 58 of FIG. 4 has an inner member 60 shaped somewhat like an air foil and an outer member 62 with a projecting male stud member 64. The outer member 62 typically will be cammed on its outer surface 66 allowing it to be a self-loading deflector as previously described.

When the tape 70 is being translated away from the anchor 68, the tape 70 will pull away from the male stud 64. When the drive tape 70 is translated towards the anchor 68, the drive tape 70 will be forced to a position to allow the male stud 64 to engage with one of the slots of the tape 70. The above causes the deflector 58 to grab the tape 70 and therefore cause the loop created by the tape to be deflected in an upward direction. As was the case in the embodiment described in FIGS. 1, 2, and 3, the deflector 58 of FIG. 4 may be made integral with the frame member.

Figure 5:
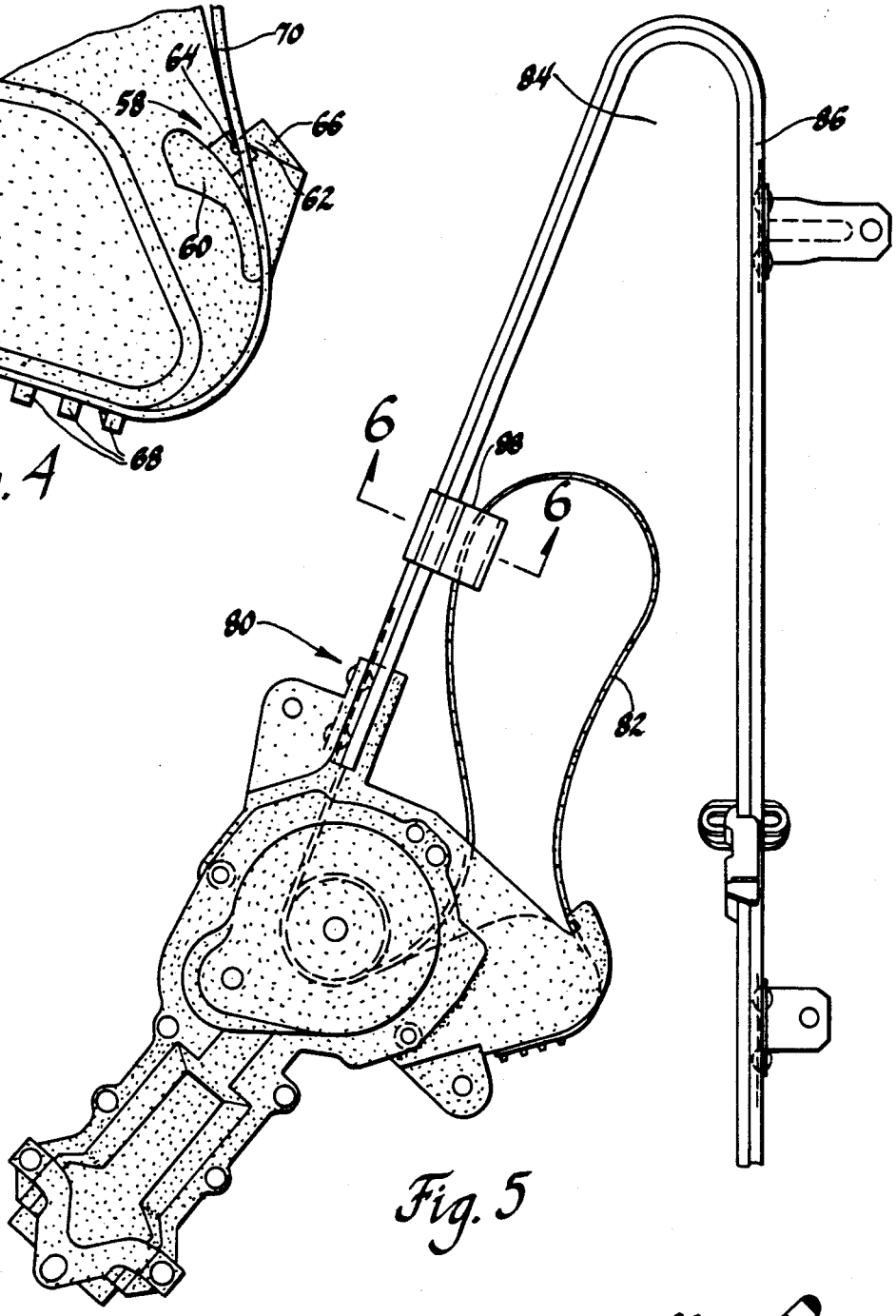
FIG. 5 is a front elevational view of an embodiment of the present invention having a lateral stabilizer.
Figure 6:
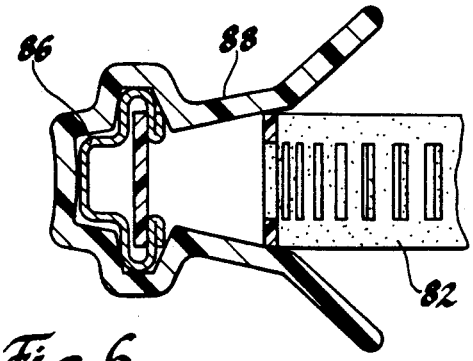
FIG. 6 is a sectional view taken along lines 6—6 of FIG. 5.

Referring to FIGS. 5 and 6 an alternative of the present invention, which laterally stabilizes the floppy portion of the drive tape is illustrated. To minimize the space taken up by the window regulator 80 within the door compartment, the loop 82 of this window regulator is formed between the U-shaped acute angle 84 of the guide rail 86. To laterally stabilize the loop there is provided a U-shaped clip 88 which can be made of plastic and simply snapped on the rail 86 to laterally restrain the generated loop. Use of the lateral stabilizer allows the door compartment inner doors to be stripped of the foam rubber which is previously required to keep down the noise caused by rattling when the floppy portion of the loop sway laterally from side-to-side. As the loop 82 becomes smaller and smaller as the window (not shown) is lowered, the loop 82 eventually comes to a point where it will no longer impact upon the lateral stabilizer 88. However, at the above-described point the rigidity of the loop 82 will be at such a stage that lateral stabilization of the drive tape will not be required.

While a few of the embodiments of the present invention have been explained it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. A vehicle window tape drive regulator comprising:

a tape secured at one end to said window and movable at one end with respect to said vehicle for moving said window between a plurality of window positions;

anchor means securing the other end of said tape in a fixed position with respect to said vehicle;

said tape having a slack portion between the ends thereof which is normally freely movable with respect to said vehicle when said window is in one of said window positions;

guide means providing a predetermined path for said tape when it moves said window and and opening at one end of said path to accommodate said slack portion;

drive means drivably engaged with said tape between said ends thereof and operable in one manner to move said tape to move said window to one window position while creating said slack portion and operable in another manner to move said tape to move said window to another window position while taking up at least some of said slack portion; and deflection means at said opening between, said path and said anchor means having a first surface towards said anchor and guide means and an opposite cam surface for allowing said drive means to load said tape from an area adjacent to said cam surface to an area adjacent to said first surface, said first surface after said tape loading engaging said slack portion during creation thereof to restrict the movement of said tape with respect to said vehicle.

2. A window regulator as described in claim 1 wherein said deflection means also grabs said slack portion during creation thereof to restrict the movement of said tape with respect to said vehicle.

3. A vehicle window tape drive regulator comprising:

a tape secured at one end to said window and movable at one end with respect to said vehicle for moving said window between a plurality of window positions;

anchor means securing the other end of said tape in a fixed position with respect to said vehicle;

said tape having a slack portion between the ends thereof which is normally freely movable with respect to said vehicle when said window is in one of said window positions;

guide means providing a predetermined path for said tape when it moves said window and an opening at one end of said path to accommodate said slack portion;

drive means drivably engaged with said tape between said ends thereof and operable in one manner to move said tape to move said window to one window position while creating said slack portion and operable in another manner to move said tape to move said window to another window position while taking up at least some of said slack portion; and deflection means at said opening between said path and said anchor means for grabbing said slack portion during creation thereof to restrict the movement of said tape with respect to said vehicle.

4. A vehicle window tape drive regulator comprising:

a tape secured at one end to said window and movable at one end with respect to said vehicle for moving said window between a plurality of window positions;

anchor means securing the other end of said tape in a fixed position with respect to said vehicle;

said tape having a slack portion between the ends thereof which is normally freely movable with respect to said vehicle when said window is in one of said window positions;

guide means providing a predetermined path for said tape when it moves said window and an opening at one end of said path to accommodate said slack portion;

drive means drivably engaged with said tape between said ends thereof and operable in one manner to move said tape to move said window to one window position while creating said slack portion and operable in another manner to move said tape to move said window to another window position while taking up at least some of said slack portion; and lateral stabilization means attached to said guide means engaging said slack portion during creation thereof to transversely restrict the movement of said tape with respect to said vehicle.

5. A window regulator as described in claim 4 wherein said guide means includes an elongated rail and wherein said lateral stabilization means is attached to said rail.

6. A vehicle window tape drive regulator comprising:

a tape secured at one end to said window and movable at said one end with respect to said vehicle for moving said window between a plurality of window positions;

anchor means securing the other end of said tape in a fixed position with respect to said vehicle;

said tape having a slack portion between the ends thereof which is normally freely movable with respect to said vehicle when said window is in one of said window positions;

guide means providing a predetermined path for said tape when it moves said window and opening at one end of said path to accommodate said slack portion, said guide means including an elongated rail having an acute angle between its opposite ends and said slack portion being adjacent the acute angle created by said rail member;

drive means drivably engaged with said tape between said ends thereof and operable in one manner to move said tape to move said window to one window position while creating said slack portion and operable in another manner to move said tape to move said window to another window position while taking up at least some of said slack portion; and a deformable U-shaped clip press-fitted upon said rail to laterally engage the slack portion of said tape during creation thereof to transversely restrict the movement of said tape with respect to said vehicle.

7. A vehicle window tape drive regulator, said regulator comprising in combination:

a tape with a plurality of equally spaced slotted apertures secured to said window at a first end;

guide means providing a predetermined path for said tape;

reversible drive means drivably engaged with said tape to translate said tape along said guide means in two directions;

anchor means spaced from said guide means fixably securing a second end of said tape;

deflection means adjacent to said guide and said anchor means, said deflection means having a male member whereby translation of said tape towards said anchor means causes said male member to engage into one of said slotted apertures of said tape causing said deflection means to grab said tape.

8. A window regulator as described in claim 7 wherein said deflection means includes an outer deflector member and an inner deflector member wherein said tape is captured between said inner and outer deflector members and wherein said male member is connected with said outer deflector member and projects towards said inner member.

9. A vehicle window tape drive regulator, said regulator comprising in combination:

a tape with a series of equally spaced slotted apertures secured to said window at a first end;

guide means providing a predetermined path for said tape;

reversible drive means drivably engaged with said tape to translate said tape along said guide means in two directions;

anchor means spaced from said guide means fixably securing a second end of said tape; and deflection means adjacent to said guide and anchor means, said deflection means including an inner member and an outer male member separated from each other by said tape, whereby translation of said tape towards said anchor means causes said male member to be inserted within an aperture of said tape causing said deflection means to grab said tape and causing said tape to be deflected upwardly.

10. A vehicle window tape drive regulator, said regulator comprising in combination:

a tape with a plurality of longitudinally equally spaced transverse slotted apertures secured to said window at a first end;

guide means providing a predetermined path for said tape;

reversible drive means drivably engaged with said tape to translate said tape along said guide means in two directions;

anchor means spaced from said guide means fixably securing a second end of said tape; and a deflector including an inner deflector member adjacent with said tape between said guide means and said anchor means and an outer deflection member having a male member projecting towards said inner member whereby translation of said tape towards said anchor means causes said male member to insert into said tape causing said tape to deflect upwards and whereby said outer deflection member has a surface opposite said male member providing a cam surface allowing said drive means to load said tape from an area adjacent said cam surface to an area adjacent said male member.

11. A method of adjusting the position of a window utilizing a tape drive window regulator having a tape attached at one end with a window and an opposite tape end fixed with respect to said vehicle, said method includes;

translating said tape towards a fixed anchor through a guided means;

creating floppy portion of tape in an opening between said guided means and said anchor; and deflecting the tape by deflector located between said guided means and said anchor which grabs the tape when the tape translates towards said anchor.

12. A method of adjusting the position of a window utilizing a tape drive window regulator having a tape attached at one end with a window and an opposite tape end fixed with respect to said vehicle, said method includes;

translating said tape towards a fixed anchor through a guided means;

creating a floppy portion of the tape in an opening between said guided means and said anchor;

and laterally stabilizing the floppy portion of the tape.

13. A method of loading the tape of a tape drive window regulator having a guided means providing a fixed path of translating for a portion of said tape and an anchor means wherein the tape is fixed in respect to said vehicle by said anchor means, and deflector means located between said anchor and guide means having a cam surface on said deflector side opposite said guide and anchor means, and a power means to translate said tape towards or away said window said method including;

placing the tape in an area adjacent to said deflector cam surface;

translating the tape by operation of said power means towards said window bringing said tape to said cam surface;

deflecting the tape after said tape is brought over said cam surface when said tape is translated in a direction away from said window.

* * * * *